US005860724A

United States Patent [19]

Cheng

[11] Patent Number: 5,860,724

[45] Date of Patent: Jan. 19, 1999

[54] LUMINESCENT LIGHT EMITTER OF AN ICE CUBE SHAPE

[75] Inventor: Kun-Chuan Cheng, Tainan, Taiwan

[73] Assignee: Kai Gee Enterprise Co., Ltd., Tainan, Taiwan

[21] Appl. No.: 954,515

[22] Filed: Oct. 20, 1997

[51] Int. Cl.[6] ..... F21K 2/00

[52] U.S. Cl. ..... 362/34; 362/267; 206/219

[58] Field of Search ..... 362/34, 84, 267, 362/200; 206/219

[56] References Cited

U.S. PATENT DOCUMENTS 4,015,111 3/1977 Spector ..... 362/34
4,193,109 3/1980 Heffernan et al. ..... 362/34
5,396,986 3/1995 Fountain et al. ..... 206/219
5,552,968 9/1996 Ladyjensky ..... 362/34

*Primary Examiner*—Thomas M. Sember
*Attorney, Agent, or Firm*—Rosenberg, Klein & Bilker

[57] ABSTRACT

A luminescent light emitter of an ice cube shape includes an inner container, an outer container, a case and an outer cap. The inner container is filled with a luminescent chemical A and the outer container with another chemical B. The inner container is disposed in the outer container and then the both are placed in the case, with the outer cap sealed on said case. If the outer cap is pressed down, a pressing block of the outer container is moved down in a tube of the inner container and breaks open a film sealing the bottom of the tube, letting the inner and the outer container communicate with each other. Then if the case is shaken, the two chemicals will mix with each other to emit luminescent light.

5 Claims, 3 Drawing Sheets

LUMINESCENT LIGHT EMITTER OF AN ICE CUBE SHAPE

BACKGROUND OF THE INVENTION

This invention relates to a luminescent light emitter of an ice cube shape, particularly to one emitting luminescent light on a table beside foods as a kind of decoration, increasing wonderful environment for persons taking a meal so as to arouse their curiosity and appetite.

First-rate restaurants generally decorate tables with fruit sculptures, ice sculptures, dry ice, etc, for augmenting worth feeling to dishes and environments. However, these stationary decorations no longer attract special attentions of customers, already becoming very common and trite.

SUMMARY OF THE INVENTION

This invention has been devised to offer a luminescent light emitter of an ice cube shape to be placed on a table for emitting luminescent light to attract attention of customers in restaurants.

A main feature of the invention is two kinds of luminescent chemicals separately filled in an inner and an outer container combined together and placed in a case sealed with an outer cap. Then, when the outer cap is pressed down, the inner and the outer container become communicating with each other, and if they are shaken, the two kinds of luminescent chemicals will mix with each other to emit luminescent light.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
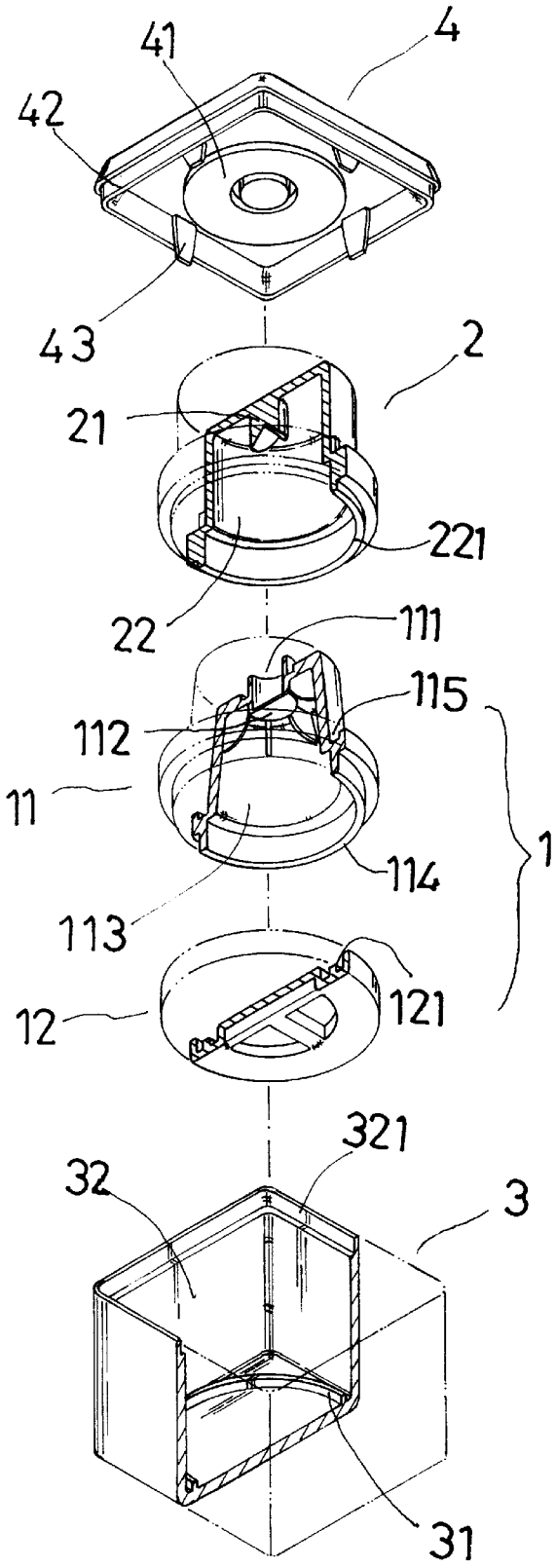
FIG. 1 is an exploded perspective view of a luminescent light emitter of an ice cube shape in the present invention.

A preferred embodiment of a luminescent light emitter of an ice cube shape in the present invention, as shown in FIG. 1, includes an inner container 1, an outer container 2, a case 3 and an outer cap 4 as main components.

The container 1 consists of a body 11 and a cap 12. The body 11 has a tube 111 passing through the center, and the tube 111 has a film 112 sealing up its bottom. The body 11 further have a mouth 113 at its bottom and an annular projecting wall 114 defining the mouth 113. An upper end of the annular projecting wall 44 is provided with an annular groove 115. The cap 12 has an annular groove 121 fitting with the annular projecting wall 114 so as to combine the cap 12 with the body 11.

The outer container 2 has a pressing block 21 formed at a center portion of an upper side and extending down for a certain length and having an inverted V-shaped pointed bottom end, and a mouth 22 formed at a bottom and fitting around the inner container 1, and an annular wall 221 formed to extend down from the mouth 22.

The case 3 has four sides, a bottom side and an upper side with a mouth 32, and an annular position projecting edge 31 on the bottom to fit around the cap 12. And the mouth 32 has an annular projecting wall 321 of a stair step shape.

The outer cap 4 closes on the mouth 32 of the case 3, having a pressing member 41 formed to protrude from the center portion of an inner surface, an annular wall 42 and a position member 43 formed in an inner surface of each side of the annular wall 42.

Figure 2:
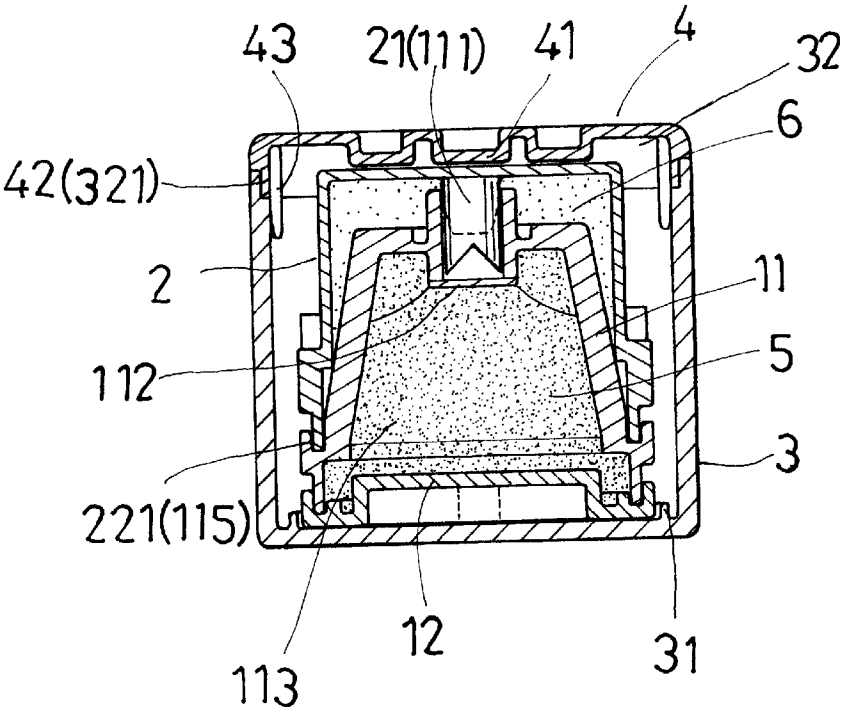
FIG. 2 is a cross-sectional view of the luminescent light emitter of an ice cube shape in the present invention.

In assembling, referring to FIG. 2, the body 11 of the inner container 1 is filled with a luminescent chemical A 5 and then the cap 12 is closed on the mouth 113 of the body 11 and sealed by some process such as supersonic welding. Next, the outer container 2 is filled with a proper quantity of another luminescent chemical B 6, and then the outer container 2 is fitted around the inner container 1 from an upper side, with the annular wall 221 engaging the annular groove 115 of the inner container 1 and then sealing the both 1 and 2 together with some process such as super-sonic process. Then the pressing block 21 of the outer container 2 may protrude in the tube 111 of the container 1, with the pointed lower end of the block 21 located a little above the film 112 of the tube 111. Then the inner container 1 combined with the outer container 2 is placed in the case 3, with the cap 12 of the inner container 1 positioned in the position edge 31 of the case 3. Next, the outer cap 4 is closed on the mouth 32 of the case 3, with the annular wall 42 of the outer cap 4 securely engaging the annular projecting wall 321 and then sealed with each other by some process such as super-sonic welding. Then this luminescent light emitter is finished in assembling. By the way, the luminescent chemicals A and B 5 and 6 may have various colors to emit various colors after they are mixed together.

Figure 3:
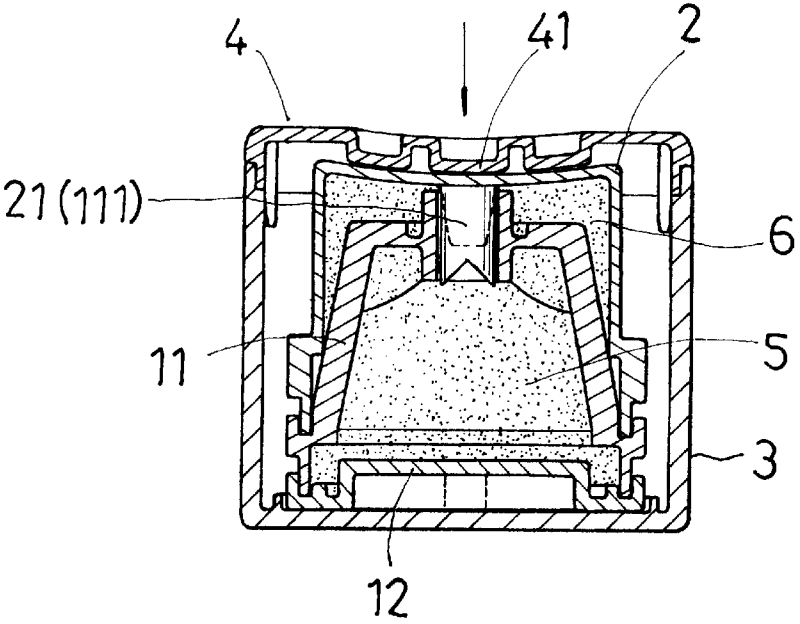
FIG. 3 is a cross-sectional view of the luminescent light emitter of an ice cube shape in the present invention, showing it being operated; and, FIG. 4 is a perspective view of the luminescent light emitter of an ice cube shape in the present invention, showing it installed in an ice sculpture.

In using, referring to FIG. 3, the outer cap 4 of the finished luminescent light emitter is pressed down, forcing the pressing member 41 of the outer cap 4 move down and also the pressing block 21 of the outer container 2 move down. Then the film 112 of the tube 111 of the container 1 will be broken by the pressing block 21. Now if the case 4 is shaken properly, the two chemicals A and B 5 and 6 in both the containers 1 and 2 will mix and react with each other to emit luminescent light.

Figure 4:
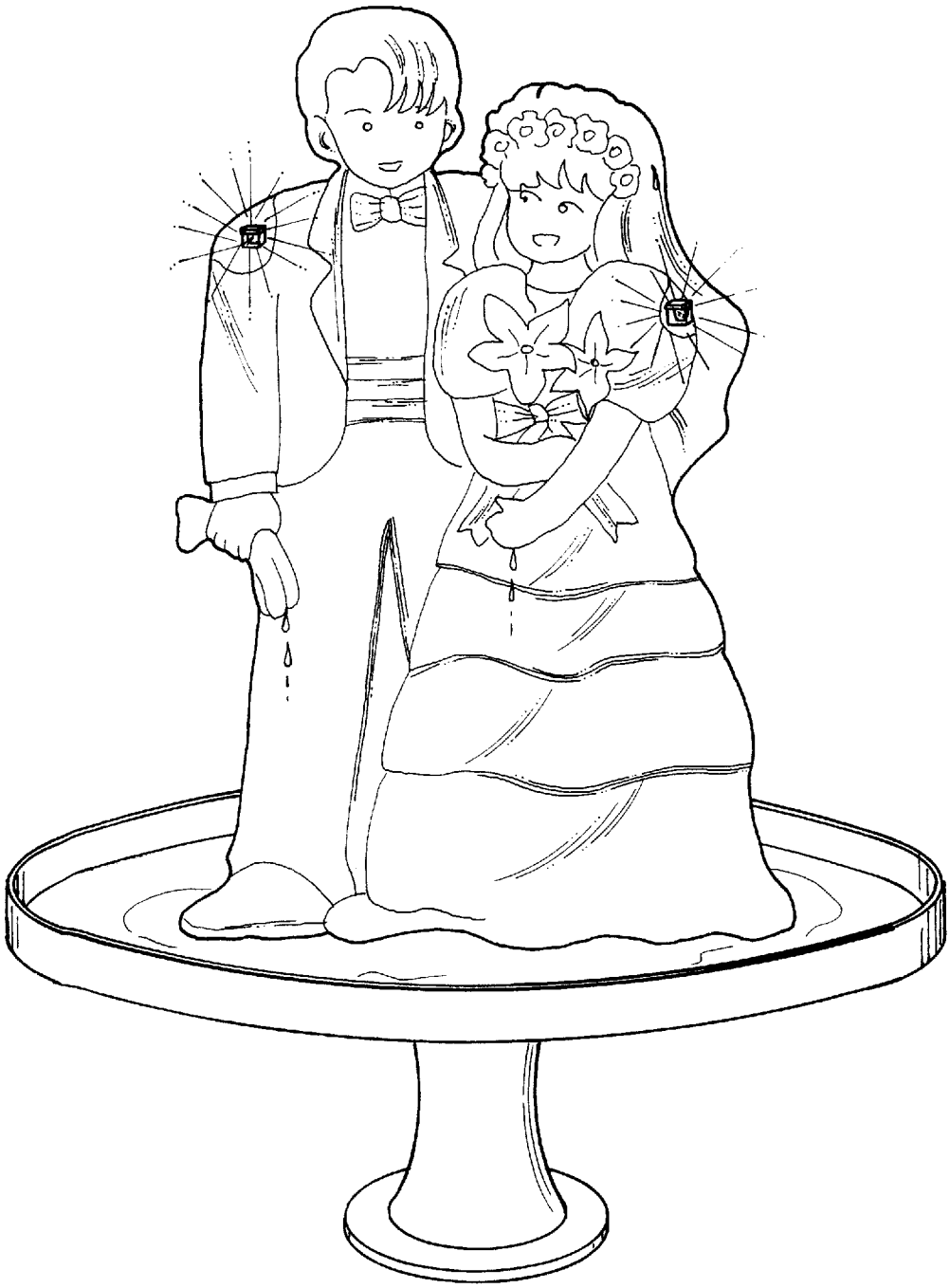

During meal time, a plurality of these luminescent light emitters are deposited in some decorations such as fruit sculptures, ice sculptures, dry ice, etc., as shown in FIG. 4. Then they emit various luminescent lights for persons taking the meal to enjoy fresh and curious environment, increasing appetite.

While the preferred embodiment of the invention has been described above, it will be recognized and understood that various modifications may be made therein and the appended claims are intended to cover all such modifications which may fall within the spirit and scope of the invention.

What is claimed is:

1. A luminescent light emitter of an ice cube shape comprising an inner container, an outer container, a case and an outer cap:

said inner container having a body and a cap closed on an open upper mouth of said body, said body filled with a proper quantity of a luminescent chemical A, said cap sealing on said body, said body having a short tube communicating with an exterior of said body, said tube having its bottom closed with a film;

said outer container filled with a proper quantity of another luminescent chemical B, and having an open bottom so as to fitting around said inner container and a pressing block extending down from the center portion of an upper side and having an inverted V-shaped pointed bottom end, said pressing block inserting in said tube of said inner container and having its bottom pointed end near said film of said tube after said outer and said inner container are combined together;

said case receiving said inner container combined sealingly with said outer container in its interior, said outer cap then closed and sealed on an open upper mouth of said case; and, said outer cap pressed down to force said pressing block of said outer container to move down and pirce open said film of said tube of said inner container, said case being shaken to force said luminescent chemicals A and B in said inner and said outer container mix with each other, said luminescent chemicals A and B emitting luminescent light when mixed with each other.

2. The luminescent light emitter of an ice cube shape as claimed in claim 1, wherein said outer container has an annular wall to fit in an annular groove provided in said inner container and then they are sealed with each other.

3. The luminescent light emitter of an ice cube shape as claimed in claim 1, wherein said open upper mouth of said case is provided with an annular wall of a stair step fitting with an annular downward wall of said outer cap and then sealed together.

4. The Luminescent light emitter of an ice cube shape as claimed in claim 1, wherein said case has an annular projecting-up edge on an upper surface of its bottom fitting with said cap of said inner container so as to secure in place said inner container combined with said outer container when said both containers are placed in said case.

5. The luminescent light emitter of an ice cube shape as claimed in claim 1, wherein said body of said inner container, said cap of said inner container, said outer container, said case and said outer cap are comletely sealed together by means of supersonic welding.

* * * * *